US010667567B2

(12) United States Patent
Chang et al.

(10) Patent No.: US 10,667,567 B2
(45) Date of Patent: Jun. 2, 2020

(54) WRIST PROTECTOR

(71) Applicants: Ki Yong Chang, Seoul (KR); Min Young Kang, Seoul (KR)

(72) Inventors: Ki Yong Chang, Seoul (KR); Min Young Kang, Seoul (KR)

( * ) Notice: Subject to any disclaimer, the term of this patent is extended or adjusted under 35 U.S.C. 154(b) by 0 days.

(21) Appl. No.: 16/112,888

(22) Filed: Aug. 27, 2018

(65) Prior Publication Data

US 2019/0191793 A1 Jun. 27, 2019

(30) Foreign Application Priority Data

Dec. 27, 2017 (KR) ..... 10-2017-0180972

(51) Int. Cl.
*A41D 13/08* (2006.01)
*A41D 13/015* (2006.01)

(52) U.S. Cl.
CPC ..... *A41D 13/0155* (2013.01); *A41D 13/08* (2013.01); *A41D 2300/32* (2013.01); *A41D 2500/00* (2013.01); *A41D 2600/10* (2013.01); *A41D 2600/20* (2013.01)

(58) Field of Classification Search
CPC ..... A61F 5/0118; A61F 5/024; A61F 5/30; A61F 5/05816; A61F 5/028; A61F 5/34; A61F 5/012; A61F 5/05866; Y10S 128/20; Y10S 2/91; Y10S 2/917; A61H 2201/1238; A61H 2201/165; A61H 9/0078; A61B 17/135; A41D 13/08; A41D 19/01523; A61G 13/0045; A61G 13/124; A63B 21/00069; A63B 21/008; A63B 21/4019; A63B 21/4025; A63B 2243/0025; A63B 23/16; A63B 71/12; A63B 71/14; A63B 71/148
See application file for complete search history.

(56) References Cited

U.S. PATENT DOCUMENTS 2,823,668 A * 2/1958 Court ..... A61F 5/05816 602/13
D259,955 S * 7/1981 Helferich ..... 2/16
4,899,763 A * 2/1990 Sebastian ..... A61F 5/0118 128/878
5,014,689 A * 5/1991 Meunchen ..... A61F 5/0118 2/16
5,020,515 A * 6/1991 Mann ..... A61F 5/05816 128/DIG. 20
5,297,541 A * 3/1994 Hensey ..... A63B 23/16 482/47

(Continued)

FOREIGN PATENT DOCUMENTS

JP 2009513262 A 4/2009
WO 2006084220 A2 8/2006

OTHER PUBLICATIONS

Halkey-roberts, Product catalog, 2016. (Year: 2016).*

*Primary Examiner* — Robert H Muromoto, Jr.
(74) *Attorney, Agent, or Firm* — Bond Schoeneck & King, PLLC

(57) ABSTRACT

A wrist protector includes a contact pad to be worn on a wrist of a user, a plurality of air tubes disposed on the contact pad, a pump configured to inject air from an outside into the plurality of air tubes, and a discharge valve configured to discharge the air stored in the plurality of air tubes to the outside.

11 Claims, 17 Drawing Sheets

(56) References Cited

U.S. PATENT DOCUMENTS

| | | | | |
|---|---|---|---|---|
| 5,427,577 | A * | 6/1995 | Picchietti | A61F 5/0118 2/161.1 |
| 5,450,638 | A * | 9/1995 | Johnson | A47C 27/084 297/DIG. 3 |
| 6,146,347 | A | 11/2000 | Porrata | |
| 7,725,950 | B2 * | 6/2010 | Hinebaugh | A41D 13/08 2/16 |
| 7,867,182 | B2 * | 1/2011 | Iglesias | A61F 5/0118 602/20 |
| D669,094 | S * | 10/2012 | Chang | D15/7 |
| D669,095 | S * | 10/2012 | Chang | D15/7 |
| 8,795,216 | B2 * | 8/2014 | Chang | A61F 5/024 128/876 |
| D833,024 | S * | 11/2018 | Chang | D24/190 |
| D833,629 | S * | 11/2018 | Chang | D24/190 |
| 2004/0092853 | A1 * | 5/2004 | Degun | A61F 5/05816 602/27 |
| 2005/0165338 | A1 * | 7/2005 | Iglesias | A61F 5/0111 602/21 |
| 2007/0167892 | A1 | 7/2007 | Gramza et al. | |
| 2013/0144198 | A1 * | 6/2013 | Chang | A61F 5/024 602/19 |
| 2014/0230827 | A1 * | 8/2014 | Jobe | A61B 17/135 128/845 |
| 2018/0338853 | A1 * | 11/2018 | Chang | A61F 5/028 |

* cited by examiner

WRIST PROTECTOR

CROSS-REFERENCE TO RELATED APPLICATION(S)

This application claims the priority benefit of Korean Patent Application No. 10-2017-0180972 filed on Dec. 27, 2017, in the Korean Intellectual Property Office, the disclosure of which is incorporated herein by reference for all purposes.

BACKGROUND

1. Field

One or more example embodiments relate to a wrist protector.

2. Description of Related Art

A wrist protector protects a delicate wrist during simple exercise or work. In general, the wrist protector alleviates a pain by enclosing the wrist and applying an appropriate pressure thereto or straightens a joint of the wrist. A general wrist protector is worn by positioning a pad on the wrist, pulling a hook-and-loop tape formed on one side of the pad and attaching the hook-and-loop tape to another side of the pad.

However, in a case of the general wrist protector, the task of positioning the pad on the wrist and the task of pulling and attaching the hook-and-loop tape are to be performed with one hand. Thus, while the hook-and-loop tape is being pulled, the pad may slide.

The above description has been possessed or acquired by the inventor(s) in the course of conceiving the present invention and is not necessarily an art publicly known before the present application is filed.

SUMMARY

An aspect provides a wrist protector that a user may easily wear with one hand.

Another aspect also provides a wrist protector of which a pressure applied to a wrist of a user is frequently adjustable while the user is wearing the wrist protector.

According to an aspect, there is provided a wrist protector including a contact pad to be worn on a wrist of a user, a plurality of air tubes disposed on the contact pad, a pump configured to inject air from an outside into the plurality of air tubes, and a discharge valve configured to discharge the air stored in the plurality of air tubes to the outside.

The wrist protector may further include a fixing hole provided in the contact pad and configured to enclose at least one finger of the user.

The plurality of air tubes may include a main air tube configured to support a lower portion of the wrist of the user, and a sub-air tube configured to communicate with the main air tube, wherein an angle formed by the main air tube and the sub-air tube may be adjustable.

The pump, the discharge valve and the fixing hole may be disposed on the same side relative to the main air tube.

The main air tube may include an air-noninjectable region formed at a central portion of the main air tube in a longitudinal direction of the main air tube.

The wrist protector may further include a main plate configured to support a lower portion of the main air tube.

The wrist protector may further include a loop plate and a sub-plate respectively formed at left and right edge portions of the contact pad, wherein the sub-air tube may include a first sub-air tube disposed between the main plate and the loop plate, and a second sub-air tube disposed between the main plate and the sub-plate.

The wrist protector may further include a check valve configured to allow an airflow from the pump to the plurality of air tubes and block an airflow from the air tubes to the pump.

The wrist protector may further include a portable pump to be mounted on the discharge valve, the portable pump configured to inject air into the plurality of air tubes.

The portable pump may include a contact portion configured to fit with the discharge valve, and an elastic body connected to an upper side of the contact portion, the elastic body having a volume greater than a volume of the pump.

According to an aspect, there is provided a wrist protector including an air tube configured to support a wrist joint of a user, a pump including an air inlet communicating with an outside and an air transfer hole communicating with the air tube, a check valve configured to allow an airflow from the pump to the air tube and block an airflow from the air tube to the pump, and a discharge valve configured to discharge air in the air tube to the outside.

The discharge valve may include a discharge hose configured to allow an airflow between the air tube and the outside, and a discharge bolt configured to open and close the discharge hose.

The discharge bolt may include a bolt flow path configured to allow the airflow between the air tube and the outside, and one end of the bolt flow path may be blocked by an inner wall of the discharge hose in a closed state and opened toward the outside in an opened state.

The discharge bolt may be spirally connected to the inner wall of the discharge hose, and a discharge end of the bolt flow path may be exposed to the outside when the discharge bolt is turned more than a predetermined angle with respect to the discharge hose.

The wrist protector may further include a protection plate formed of a more rigid material than the air tube and configured to enclose an outer circumferential surface of the air tube.

The air tube may include a first tube portion and a second tube portion partitioned on both sides by a thermobonded line formed at a center of the air tube, and a connecting tube portion configured to enable the first tube portion and the second tube portion to communicate with each other.

The air tube may include an air-noninjectable region positioned between the first tube portion and the second tube portion and enclosed by thermobonded line.

The protection plate may include a first branch plate and a second branch plate configured to branch in both directions from a central line of the protection plate, and a vent positioned between the first branch plate and the second branch plate, the vent overlapping the air-noninjectable region.

According to an aspect, there is provided a wrist protector including a first air tube configured to support an upper side of a wrist joint of a user, a second air tube configured to support a lower side of the wrist joint of the user, a pump including an air inlet communicating with an outside and an air transfer hole communicating with one air tube of the first air tube and the second air tube, a connecting hose configured to enable the first air tube and the second air tube to communicate with each other, a check valve configured to allow an airflow from the pump to the one air tube and block an airflow from the one air tube to the pump, and a discharge valve configured to discharge air in the one air tube to the outside.

Air injected into the one air tube may be injected into the other air tube of the first air tube and the second air tube through the connecting hose.

The wrist protector may further include a contact pad configured to connect the first air tube and the second air tube and be attached to and detached from the wrist joint of the user.

The wrist protector may further include a first protection plate configured to enclose an outer circumferential surface of the first air tube, a second protection plate configured to enclose an outer circumferential surface of the second air tube, and a wearable belt configured to fasten the first protection plate and the second protection plate.

The check valve and the discharge valve may be disposed in parallel between the pump and the air tube.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
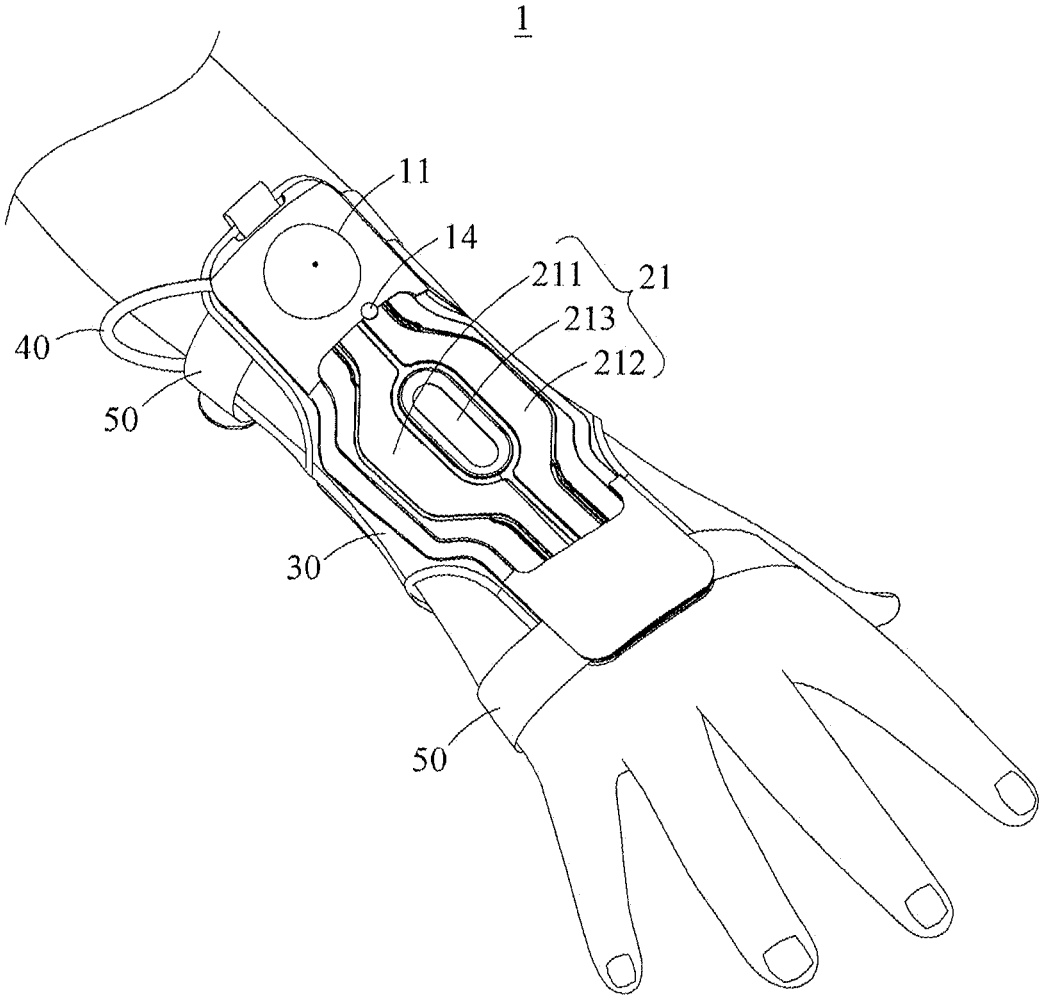
FIG. 1 is a perspective front view illustrating a user wearing a wrist protector when viewing a back of a hand of the user according to an example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

The same name may be used to describe an element included in the example embodiments described above and an element having a common function. Unless otherwise mentioned, the descriptions on the example embodiments may be applicable to the following example embodiments and thus, duplicated descriptions will be omitted for conciseness.

Figure 2:
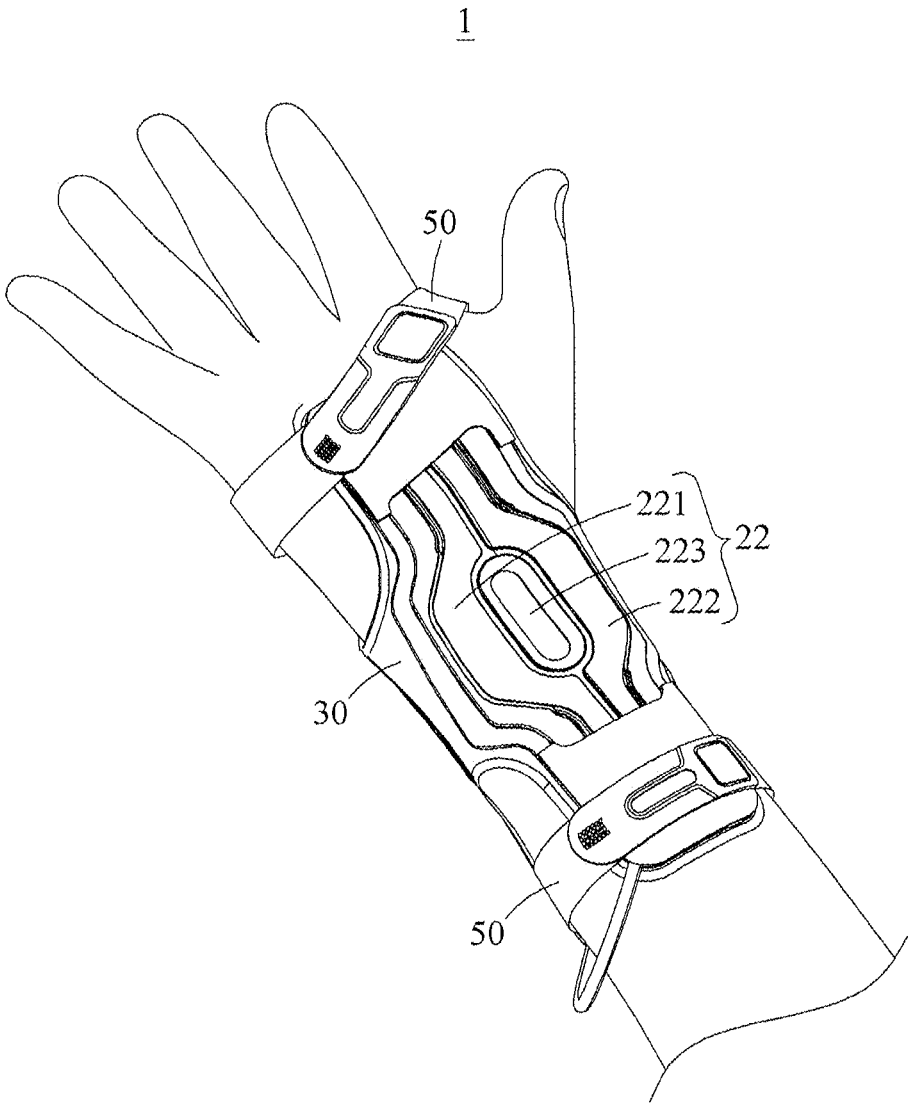
FIG. 2 is a perspective rear view illustrating a user wearing a wrist protector when viewing a palm of the user according to an example embodiment.
Figure 3:
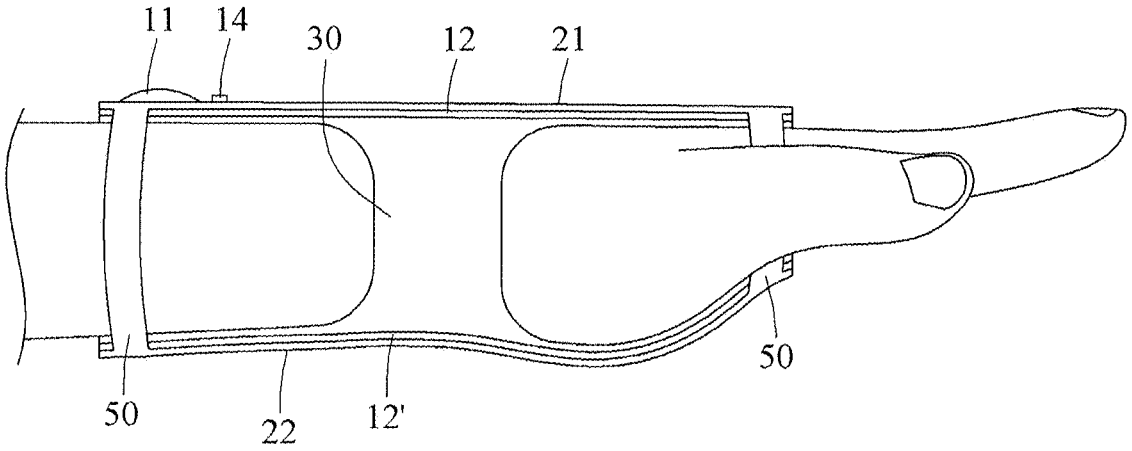
FIG. 3 is a side view illustrating a user wearing a wrist protector according to an example embodiment.
Figure 4:
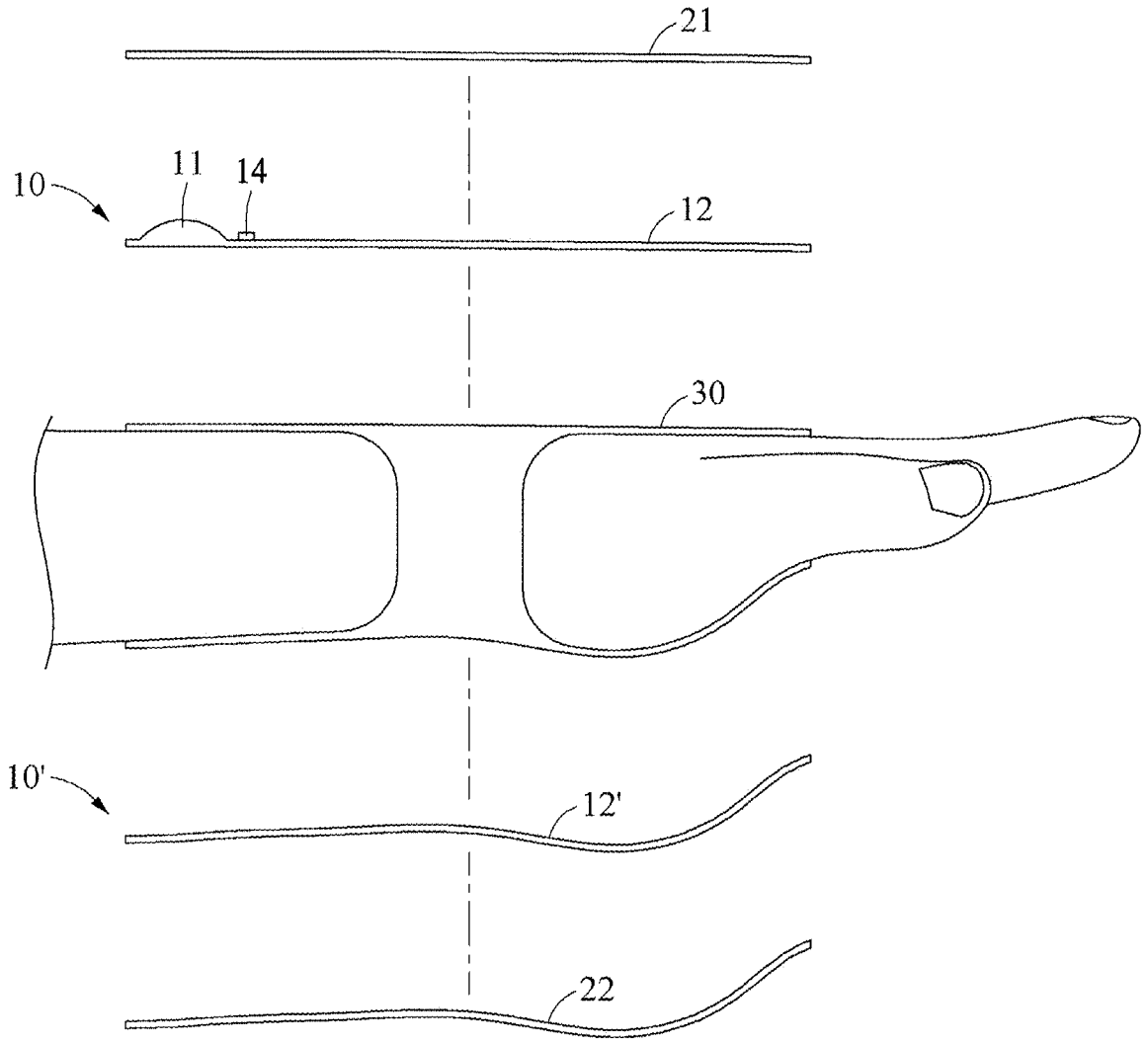
FIG. 4 is an exploded view of FIG. 3.
Figure 5:
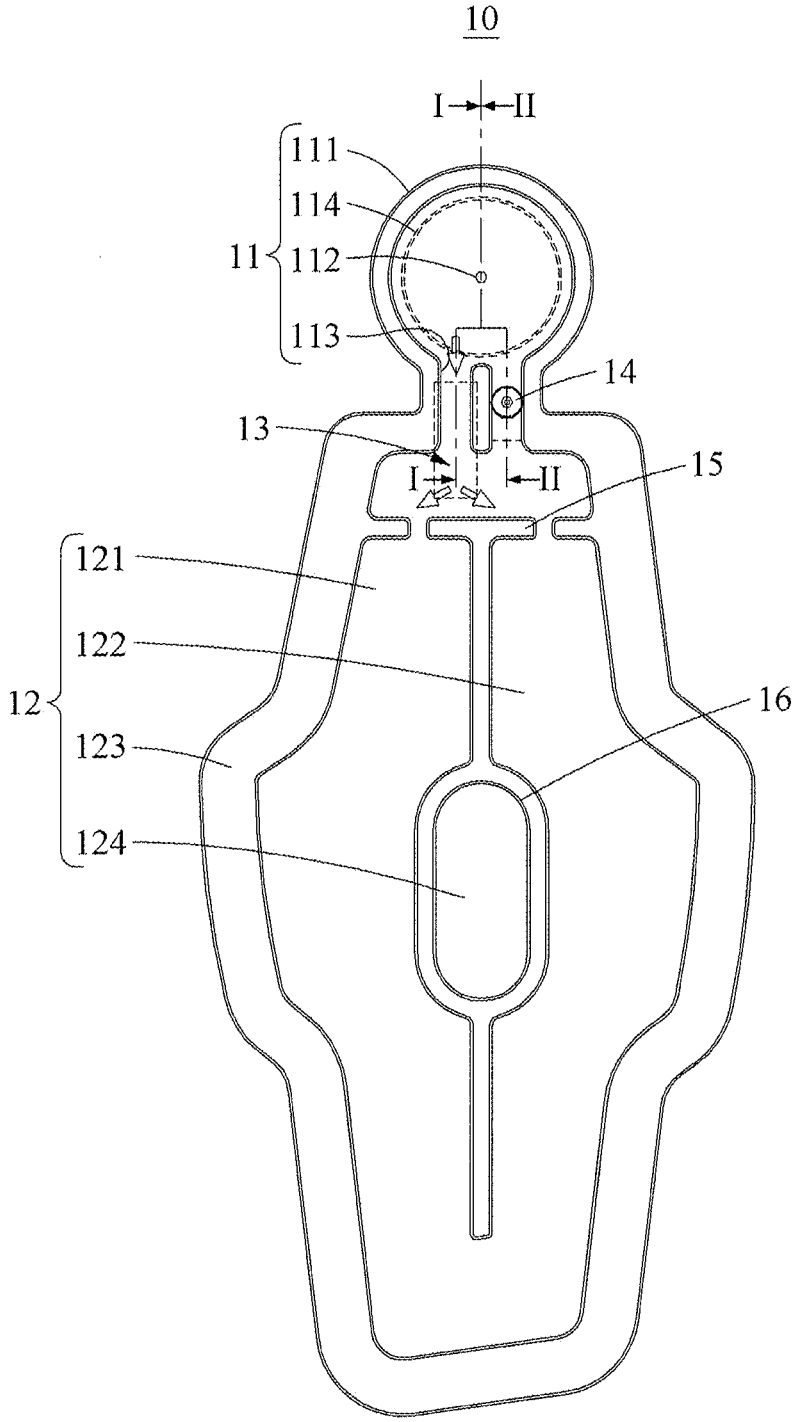
FIG. 5 is a front view illustrating an air pad according to an example embodiment.

FIG. 1 is a perspective front view illustrating a user wearing a wrist protector when viewing a back of a hand of the user according to an example embodiment, FIG. 2 is a perspective rear view illustrating the user wearing the wrist protector when viewing a palm of the user according to an example embodiment, FIG. 3 is a side view illustrating the user wearing the wrist protector according to an example embodiment, FIG. 4 is an exploded view of FIG. 3, and FIG. 5 is a front view illustrating an air pad according to an example embodiment.

Referring to FIGS. 1 through 5, a wrist protector 1 may support a wrist joint of a user. The wrist protector 1 may pressurize a wrist of the user, thereby preventing shaking of the wrist. The wrist of the user supported by the wrist protector 1 may have restricted movements in up and down and/or left and right directions. The wrist protector 1 may include an air pad 10, a protection plate 21, 22, a contact pad 30, a connecting hose 40 and a wearable belt 50. To simplify the drawings, the connecting hose 40 and the wearable belt 50 were omitted from FIG. 4.

The contact pad 30 may directly contact the wrist of the user. For example, the contact pad 30 may be wound around the wrist of the user. The contact pad 30 may be formed of fabric. The contact pad 30, the air pad 10 and the protection plate 21 may be disposed sequentially in a direction vertically away from a back of a hand. Similarly, the contact pad 30, the air pad 10 and the protection plate 22 may be disposed sequentially in a direction vertically away from a palm. Meanwhile, a case in which the contact pad 30 is omitted, and the air pad 10 directly contacts the wrist of the user may also be possible.

The air pad 10 may include a pump 11, an air tube 12, a check valve 13 and a discharge valve 14. The user may inject air into the air pad 10 and discharge the air stored in the air pad 10. Based on an amount of the air stored in the air pad 10, a supporting force of the wrist protector 1 may be adjusted. In a case in which the wrist of the user requires a relatively great supporting force, for example, bones and/or ligaments of the wrist are damaged, the user may increase the amount of the air stored in the air pad 10, thereby increasing the supporting force of the air pad 10. Meanwhile, in a case in which the wrist of the user requires a relatively weak supporting force, for example, muscles of the wrist are damaged, the user may reduce the amount of the air stored in the air pad 10, thereby decreasing the supporting force of the air pad 10.

The pump 11 may inject air into the air tube 12. The pump 11 may be formed of an elastic material. The pump 11 may have a convex shape including a hollow in an initial state. Although the user deforms the pump 11 with a finger and/or the palm of the user, the pump 11 may return to the initial state.

The pump 11, the air tube 12, and a first connecting flow path and a second connecting flow path that enable the pump 11 and the air tube 12 to communicate with each other in parallel may be formed as an integral body by two thermobonded members, for example, two vinyl sheets, an upper vinyl sheet and a lower vinyl sheet. The pump 11 and the air tube 12 may form an internal space and communicate with each other as edge portions thereof are thermobonded. For example, a portion of the two vinyl sheets may be thermobonded in a round shape to form the pump 11, and another portion of the two vinyl sheets may be thermobonded at edge portions thereof to form the air tube 12. Further, by thermobonding three portions parallel to each other between the pump 11 and the air tube 12, two connecting flow paths having widths narrower than widths of the pump 11 and the air tube 12, that is, the first connecting flow path and the second connecting flow path, may be formed in parallel. Further, the check valve 13 and the discharge valve 14 may be disposed in parallel to each other respectively on the first connecting flow path and the second connecting flow path.

The pump 11 may include a pump body 111, an air inlet 112 formed on one side of the pump body 111 and communicating with an outside, an air transfer hole 113 formed on another side of the pump body 111 and communicating with the air tube 12, and an elastic body 114 to maintain a shape of the pump body 111 in a state in which an external force is not applied thereto.

The pump body 111 may correspond to the two vinyl sheets, for example, the upper vinyl sheet and the lower vinyl sheet, with at least a portion of the edge portions thereof thermobonded to each other. The pump body 111 may have an internal hollow in which the air may be temporarily stored.

The air inlet 112 may be a hole formed in one vinyl sheet, for example, the upper vinyl sheet or the lower vinyl sheet, of the two vinyl sheets, for example, the upper vinyl sheet and the lower vinyl sheet. The air inlet 112 may enable the internal hollow of the pump body 111 and the outside to communicate with each other. To inject the air in the pump body 111 into the air tube 12, the user may pressurize the pump body 111 while closing up the air inlet 112. In this example, the air in the pump body 111 may be discharged only through the air transfer hole 113, rather than being discharged through the air inlet 112. That is, the user may effectively transfer the air into the air tube 12.

The air transfer hole 113 may be a non-thermobonded portion of the two vinyl sheets, for example, the upper vinyl sheet and the lower vinyl sheet, with at least a portion of the edge portions thereof thermobonded to each other. The air transfer hole 113 may enable the internal hollow of the pump body 111 and the air tube 12 to communicate with each other. The check valve 13 may be provided in the air transfer hole 113, whereby a one-way airflow may be implemented.

The elastic body 114 may be formed of an elastic material and thus elastically restored. In a case in which an external force is not applied thereto, the elastic body 114 may maintain an initial shape of the pump body 111(see FIG. 6). For example, in a case in which the user applies an external force to pressurize the pump body 111 with a finger or the palm of the user (see FIG. 7), the pump body 111 may be shrunken, and the elastic body 114 disposed in the pump body 111 may also be shrunken. In a case in which the external force is not applied any further, the elastic body 114 may return to its initial shape, and thus the pump body 111 may return to its initial shape. The elastic body 114 may be positioned in the two thermobonded vinyl sheets.

While a volume of the elastic body 114 is increasing, external air may be injected into the pump 11 through the air inlet 112. Conversely, while the volume of the elastic body 114 is decreasing, the air in the pump 11 may be injected into the air tube 12.

For example, the elastic body 114 may have a hollow and include one or a plurality of holes. In this example, while the volume of the elastic body 114 is increasing, ambient air may be injected into the hollow of the elastic body 114 through the hole(s). Conversely, while the volume of the elastic body 114 is decreasing, the air in the hollow of the elastic body 114 may be discharged to the outside through the hole(s). For example, the plurality of holes may include a first hole 1141 (see FIG. 6) communicating with the air inlet 112 and a second hole 1142 (see FIG. 6) communicating with the air transfer hole 113.

The air tube 12 may support the wrist joint of the user. The air tube 12 may store air therein, and a supporting force to be applied to the user may be adjusted based on an amount of the air stored in the air tube 12. The user may easily adjust the amount of the air stored in the air tube 12.

Air tubes may be disposed respectively on both sides from the wrist of the user. For example, the air tubes may include a first air tube 12 to support an upper side of the wrist joint of the user and a second air tube 12' to support a lower side of the wrist joint of the user.

A tube body 123 may correspond to the two vinyl sheets, for example, the upper vinyl sheet and the lower vinyl sheet, with at least a portion of the edge portions thereof thermobonded to each other. The tube body 123 may be connected to the pump body 111. For example, the tube body 123 and the pump body 111 may be formed by the same two vinyl sheets, for example, the upper vinyl sheet and the lower vinyl sheet. The tube body 123 may include a hollow. The hollow of the tube body 123 may correspond to a non-thermobonded portion of the two vinyl sheets. Air may be stored in the hollow of the tube body 123. The hollow of the tube body 123 may include a first tube portion 121, a second tube portion 122, and a connecting tube portion to enable the first tube portion 121 and the second tube portion 122 to communicate with each other. For example, the connecting tube portion and the pump 11 may be positioned on opposite sides from a center of the tube body 123.

Air may be injected into the first tube portion 121, the second tube portion 122 and the connecting tube portion. As shown in FIGS. 1 through 4, the first tube portion 121, the second tube portion 122 and the connecting tube portion may be disposed between the contact pad 30 and the protection plate 21, 22. An outer boundary of the first tube portion 121 and the second tube portion 122 may be formed of a deformable material, for example, vinyl, and thus the first tube portion 121 and the second tube portion 122 may fill an inner space between the contact pad 30 and the protection plate 21, 22 formed of relatively rigid materials. A distance between the protection plates 21 and 22 may be maintained by the wearable belt 50. Thus, as an amount of air injected into the first tube portion 121 and the second tube portion 122 increases, a magnitude of the supporting force to be applied to the user may increase.

The first tube portion 121 and the second tube portion 122 may be disposed respectively on both sides from a central line of the air pad 10. A thermobonded line 15 may be provided between the first tube portion 121 and the second tube portion 122. By the thermobonded line 15, the first tube portion 121 and the second tube portion 122 may be bent to correspond to a shape of the wrist of the user.

The air tube 12 may include an air-noninjectable region 124 positioned between the first tube portion 121 and the second tube portion 122 and enclosed by the thermobonded line 15. By the air-noninjectable region 124 and the thermobonded line 15, an air-permeability of the air tube 12 may be secured.

The connecting tube portion may enable the air to flow between the first tube portion 121 and the second tube portion 122, thereby enabling the entire air tube 12 to be deformed easily and adaptively to various body shapes of users.

The check valve 13 may allow an airflow from the pump 11 to the air tube 12 and block an airflow from the air tube 12 to the pump 11. A mechanism of the check valve 13 will be described in detail with reference to FIGS. 6 and 7.

The discharge valve 14 may discharge the air in the air tube 12 to the outside. A mechanism of the discharge valve 14 will be described in detail with reference to FIGS. 8 and 9.

Meanwhile, referring to FIG. 5, the check valve 13 and the discharge valve 14 may be disposed in parallel between the pump 11 and the air tube 12. By the above parallel arrangement, the user may perform the task of injecting air into the air tube 12 through the pump 11 and the task of discharging the air in the air tube 12 to the outside through the discharge valve 14 at adjacent positions, thereby adjusting a pressure of the air tube 12 conveniently. For example, in a case in which an excessive amount of air is injected through the pump 11, and the user feels an excessive pressure on the wrist, the user may immediately adjust the discharge valve 14 adjacent to the pump 11 to reduce the pressure.

The protection plate 21, 22 may be formed of a more rigid material than the air tube 12, 12' and enclose an outer circumferential surface of the air tube 12, 12'. The protection plate 21, 22 may be formed of, for example, plastic and prevent damage to the air tube 12, 12'. The protection plate 21, 22 may include the first protection plate 21 that encloses the first air tube 12 to support the upper side of the wrist joint of the user, and the second protection plate 22 that encloses the second air tube 12' to support the lower side of the wrist joint of the user.

The first protection plate 21 may have a shape corresponding to an angle of inclination from an upper portion of the wrist of the user and the back of the hand of the user. For example, the first protection plate 21 may have a mostly flat shape. The second protection plate 22 may have a shape corresponding to an angle of inclination from a lower portion of the wrist of the user and the palm of the user. For example, the second protection plate 22 may have a shape with an inclination of about 20 degrees to 30 degrees. The shape of the second protection plate 22 will be described further later with reference to FIG. 10.

Similar to the air tube 12, the protection plate 21, 22 may have a shape that branches in both directions from a central line of the protection plate 21, 22. For example, the first protection plate 21 may branch in both directions from the central line of the first protection plate 21 and thus, include a first branch plate 211 and a second branch plate 212 that may be bent to correspond to the shape of the wrist of the user. Further, the first protection plate 21 may include a vent 213 positioned between the first branch plate 211 and the second branch plate 212, the vent 213 overlapping the air-noninjectable region 124 of the air tube 12. The vent 213 may secure an air-permeability between the outside and the air tube 12. External air may enter a space under the air-noninjectable region 124 and the thermobonded line 15 through the vent 213. Similarly, air warmed by the body temperature of the user in the space under the air-noninjectable region 124 and the thermobonded line 15 may be discharged to the outside through the vent 213. The vent 213, the air-noninjectable region 124 and the thermobonded line 15 may reduce sweat from the wrist potion of the user wearing the wrist protector 1. Similarly, the second protection plate 22 may include a first branch plate, a second branch plate and a vent.

The contact pad 30 may connect the first air tube 12 and the second air tube 12' and be attached to and detached from the wrist joint of the user. By the above structure, a process of mounting the first air tube 12 and the second air tube 12' is unnecessary, and thus the user may conveniently wear the wrist protector 1 on the wrist joint.

The connecting hose 40 may enable the first air tube 12 and the second air tube 12' to communicate with each other. For example, the pump 11 may be connected to any one air tube of the first air tube 12 and the second air tube 12'. For example, the pump 11 may be provided in the first air tube 12, and the pump 11 may not be provided on one side of the second air tube 12'. Through the pump 11, air injected from the outside into the first air tube 12 may be injected into the second air tube 12' through the connecting hose 40. That is, the user may inject the air into both the first air tube 12 supporting the upper side of the wrist joint and the second air tube 12' supporting the lower side of the wrist joint through the single pump 11.

The wearable belt 50 may fasten the first protection plate 21 disposed on the upper side of the wrist joint of the user and the second protection plate 22 disposed on the lower side of the wrist joint of the user. The distance between the first protection plate 21 and the second protection plate 22 may be adjusted by the wearable belt 50. For example, the wearable belt 50 may include a hook-and-loop structure. A plurality of wearable belts 50 may be provided in a longitudinal direction of the first protection plate 21 and/or the second protection plate 22.

Figure 6:
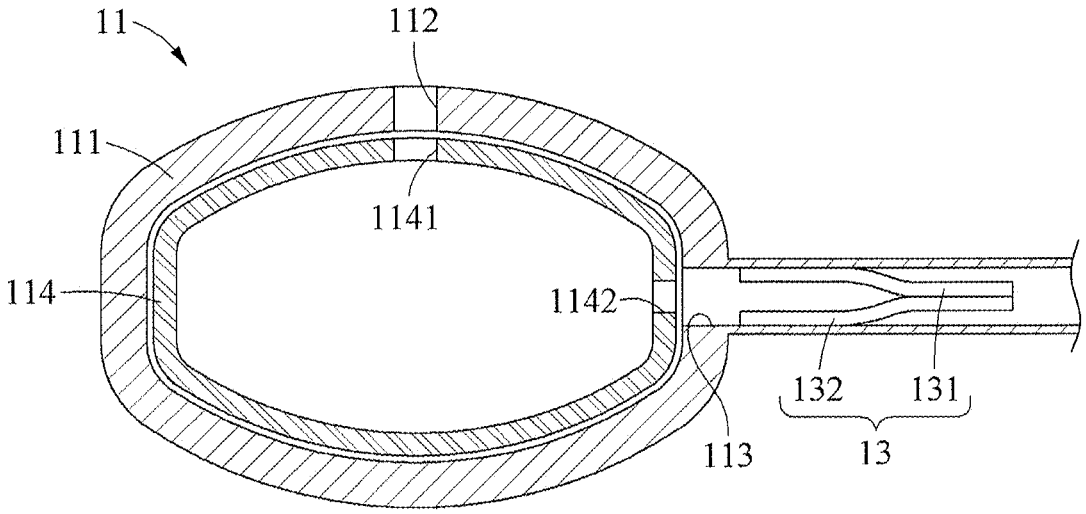
FIG. 6 is a cross-sectional view, cut along I-I of FIG. 5, illustrating a check valve being in a closed state.
Figure 7:
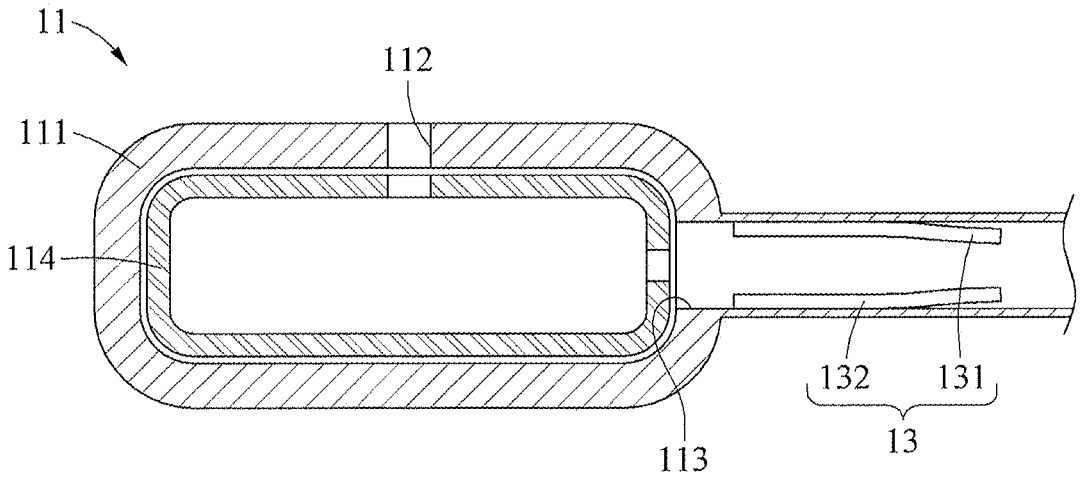
FIG. 7 is a cross-sectional view, cut along I-I of FIG. 5, illustrating a check valve being in an opened state.

FIG. 6 is a cross-sectional view, cut along I-I of FIG. 5, illustrating a check valve being in a closed state, and FIG. 7 is a cross-sectional view, cut along I-I of FIG. 5, illustrating the check valve being in an opened state.

Referring to FIGS. 6 and 7, the check valve 13 may be attached to an inner wall of the air transfer hole 113 of the pump 11. The check valve 13 may include, as in the example of FIGS. 6 and 7, a first thin film 131 to be attached to an upper inner wall of the air transfer hole 113 and a second thin film 132 to be attached to a lower inner wall of the air transfer hole 113. A region of the first thin film 131 which is relatively close to the pump 11 may be fixed to the inner wall of the air transfer hole 113, and a region of the first thin film 131 which is relatively far from the pump 11 may not be fixed to the inner wall of the air transfer hole 113. Similarly, a region of the second thin film 132 which is relatively close to the pump 11 may be fixed to the inner wall of the air transfer hole 113, and a region of the second thin film 132 which is relatively far from the pump 11 may not be fixed to the inner wall of the air transfer hole 113.

The first thin film 131 and the second thin film 132 may maintain a state of contacting each other by static electricity in a case in which the pump 11 does not operate. For example, when an external force is not applied to the pump 11, and the pump body 111 of the pump 11 maintains the initial state, the first thin film 131 and the second thin film 132 may maintain the state of contacting each other, and an airflow in the air transfer hole 113 may be prevented.

Referring to FIG. 6, the first thin film 131 and the second thin film 132 may be in a state of partially contacting each other. For example, a portion of the first thin film 131 which is relatively far from the pump 11 and a portion of the second thin film 132 which is relatively far from the pump 11 may be in a state of contacting each other. Meanwhile, a portion of the first thin film 131 which is relatively close to the pump 11 and a portion of the second thin film 132 which is relatively close to the pump 11 may each be attached to the air transfer hole 113. The first thin film 131 and the second thin film 132 may maintain the state of contacting each other although an airflow from the air tube 12 to the pump 11 occurs.

Referring to FIG. 7, the first thin film 131 and the second thin film 132 may be spaced apart from each other in a case in which an airflow from the pump 11 to the air tube 12 occurs. For example, in a case in which the pump body 111 of the pump 11 is shrunken by an external force, air in the pump 11 may flow in a direction toward the air tube 12. The first thin film 131 and the second thin film 132 may be separated from each other by the airflow. The first thin film 131 and the second thin film 132 may return to the state of contacting each other by static electricity in a case in which the airflow disappears.

Figure 8:
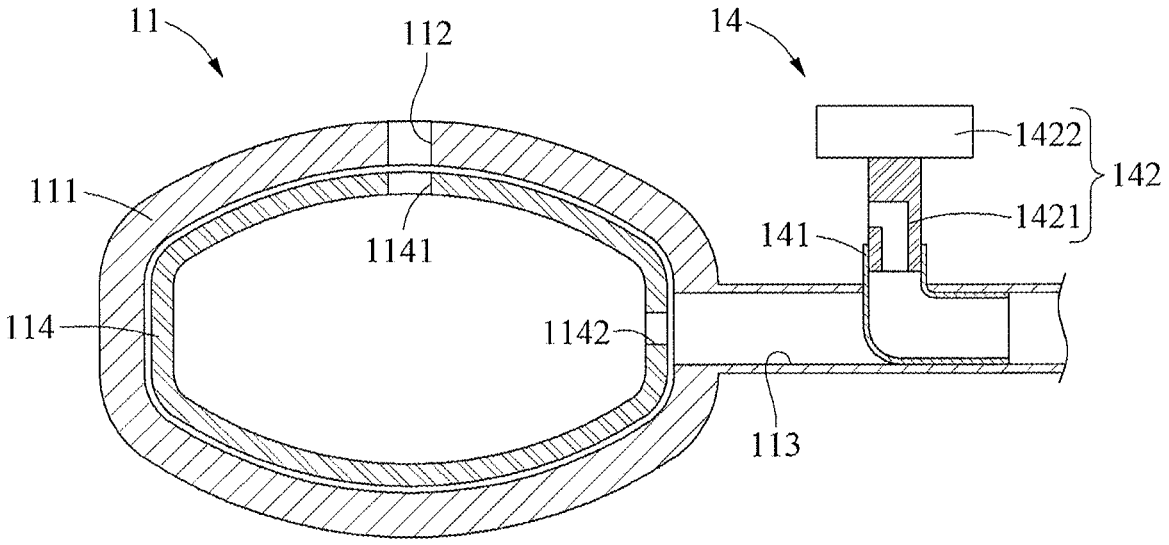
FIG. 8 is a cross-sectional view, cut along II-II of FIG. 5, illustrating a discharge valve being in an opened state.
Figure 9:
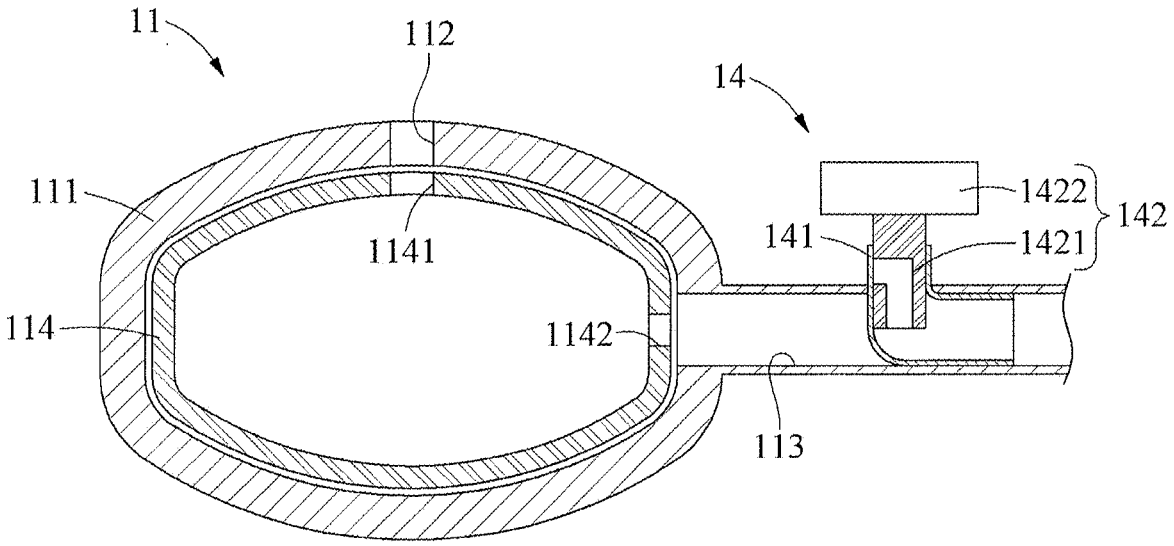
FIG. 9 is a cross-sectional view, cut along II-II of FIG. 5, illustrating a discharge valve being in a closed state.

FIG. 8 is a cross-sectional view, cut along II-II of FIG. 5, illustrating a discharge valve being in an opened state, and FIG. 9 is a cross-sectional view, cut along II-II of FIG. 5, illustrating the discharge valve being in a closed state.

Referring to FIGS. 8 and 9, the discharge valve 14 may include a discharge hose 141 that allows an airflow between the air tube 12 and the outside, and a discharge bolt 142 that opens and closes the discharge hose 141.

The discharge hose 141 may include an outer wall that blocks an airflow in a direction from the pump 11 toward the air tube 12 and allows an airflow in a direction from the air tube 12 toward the pump 11. The airflow from the pump 11 toward the air tube 12 may be blocked by the discharge hose 141. For example, the discharge hose 141 may have a shape of "L" such that a portion thereof is provided between two vinyl sheets and another portion thereof is formed to protrude toward outer sides of the two vinyl sheets. However, the shape of the discharge hose 141 is not limited thereto.

The discharge bolt 142 may include a bolt flow path 1421 that allows the airflow between the air tube 12 and the outside. One end of the bolt flow path 1421 may be blocked by an inner wall of the discharge hose 141 in a closed state and opened toward the outside in an opened state. For example, the discharge bolt 142 may include a discharge adjuster 1422. The user may manipulate the discharge adjuster 1422 to open the bolt flow path 1421 toward the outsider or to block one end of the bolt flow path 1421.

The discharge bolt 142 may be spirally connected to the inner wall of the discharge hose 141. For example, the discharge bolt 142 and the discharge hose 141 may include threads that engage with each other. When the discharge bolt 142 is turned more than a predetermined angle with respect to the discharge hose 141, a discharge end of the bolt flow path 1421 may be exposed to the outside. In this example, the air stored in the air tube 12 may be discharged to the outside through the bolt flow path 1421.

Figure 10:
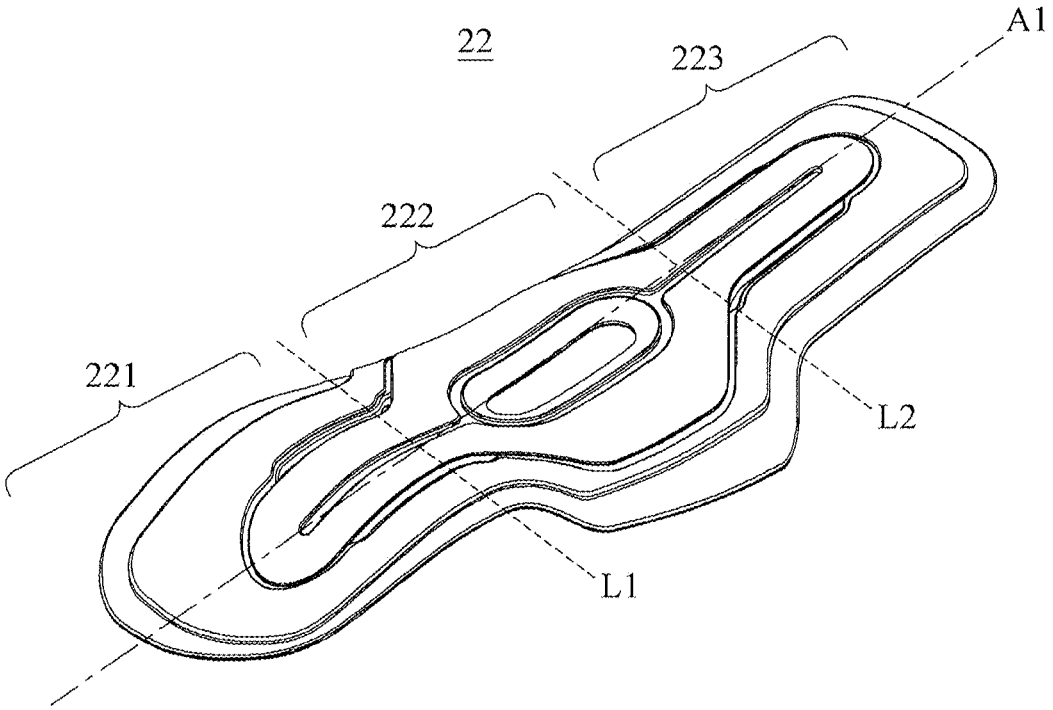
FIG. 10 illustrates a protection plate according to an example embodiment.

FIG. 10 illustrates a protection plate according to an example embodiment. FIG. 10 illustrates the second protection plate 22 of FIG. 3 which is disposed from the lower portion of the wrist of the user to the palm of the user. Hereinafter, the second protection plate 22 will be referred to as the protection plate 22.

Referring to FIG. 10, the protection plate 22 may support the lower portion of the wrist, the wrist joint, and the palm of the user. The corresponding portions of the user may have various curvatures. For example, a portion from the lower portion of the wrist of the user to the wrist joint may be convex, and a portion from the wrist joint to the palm may be curved a relatively great angle. In addition, the palm may be concave at a center thereof.

The protection plate 22 may be formed to correspond to such a body shape of the user. For example, the protection plate 22 may include three portions partitioned by a first auxiliary line L1 and a second auxiliary line L2, in detail, a first portion 221, a second portion 222 and a third portion 223.

The first portion 221 may have a shape corresponding to the palm of the user. The first portion 221 may be connected to the second portion 222 while forming a predetermined angle with the second portion 222. The first portion 221 may have a concave shape at a center thereof to stably support the palm of the user. The second portion 222 may have a shape corresponding to the wrist portion of the user. For example, the second portion 222 may have a slightly recessed shape at a center thereof so as to correspond to the wrist. The third portion 223 may have a shape corresponding to the lower portion of the wrist of the user. For example, the third portion 223 may have a convex shape to correspond to the wrist of the user which is cylindrical.

Figure 11:
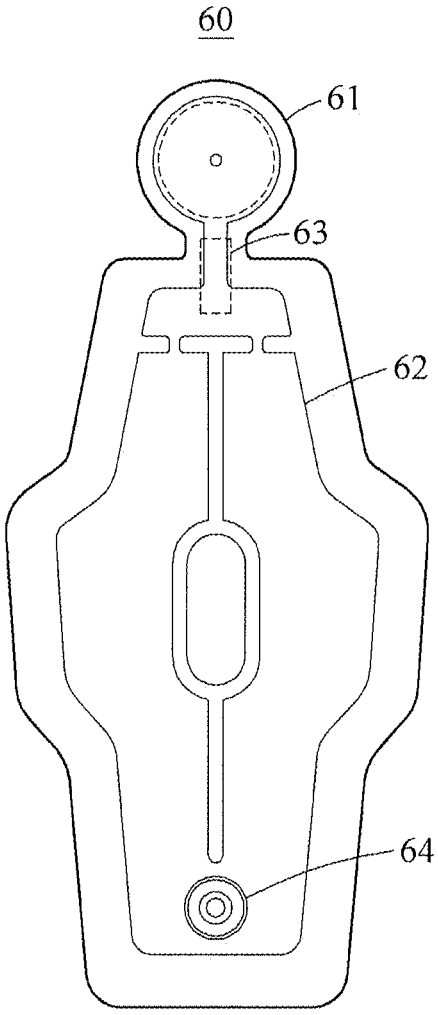
FIG. 11 is a front view illustrating an air pad according to an example embodiment.

FIG. 11 is a front view illustrating an air pad according to an example embodiment.

Referring to FIG. 11, an air pad 60 may include a pump 61, an air tube 62, a check valve 63 and a discharge valve 64. The check valve 63 and the discharge valve 64 may be formed at opposite ends, rather than being arranged in parallel to each other.

Figure 12:
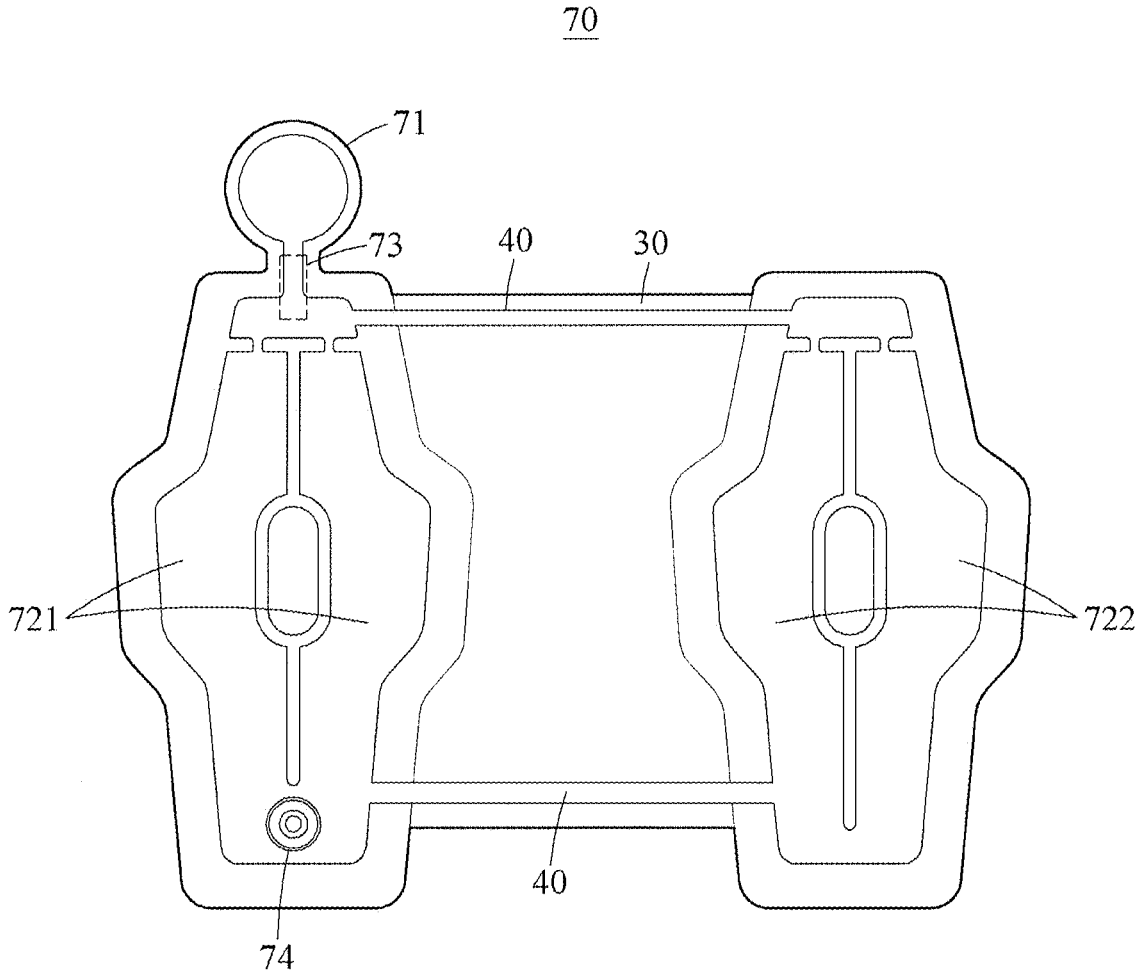
FIG. 12 is a front view illustrating an air pad according to an example embodiment.

FIG. 12 is a front view illustrating an air pad according to an example embodiment.

Referring to FIG. 12, an air pad 70 may include a pump 71, an air tube 72, a check valve 73 and a discharge valve 74. The air tube 72 may include a first air tube 721 connected to the pump 71, and a second air tube 722 not connected to the pump 71. Air injected into the first air tube 721 may be injected into the second air tube 722 through the connecting hose 40.

The contact pad 30 may connect the first air tube 721 and the second air tube 722 and be attached to and detached from the wrist joint of the user. For example, the contact pad 30 may include a hook-and-loop structure. The user may conveniently wear a wrist protector on the wrist through a task of winding the wrist with the contact pad 30 to which the first air tube 721 and the second air tube 722 are attached The user may wind the wrist with the contact pad and then increase an amount of air injected into the air pad attached to an outer circumferential surface of the contact pad, thereby conveniently wearing the wrist protector with one hand. Further, the user may increase a pressure of the air tube using the pump or decrease the pressure of the air tube using the discharge valve, thereby conveniently adjusting the pressure while wearing the wrist protector.

Figure 13:
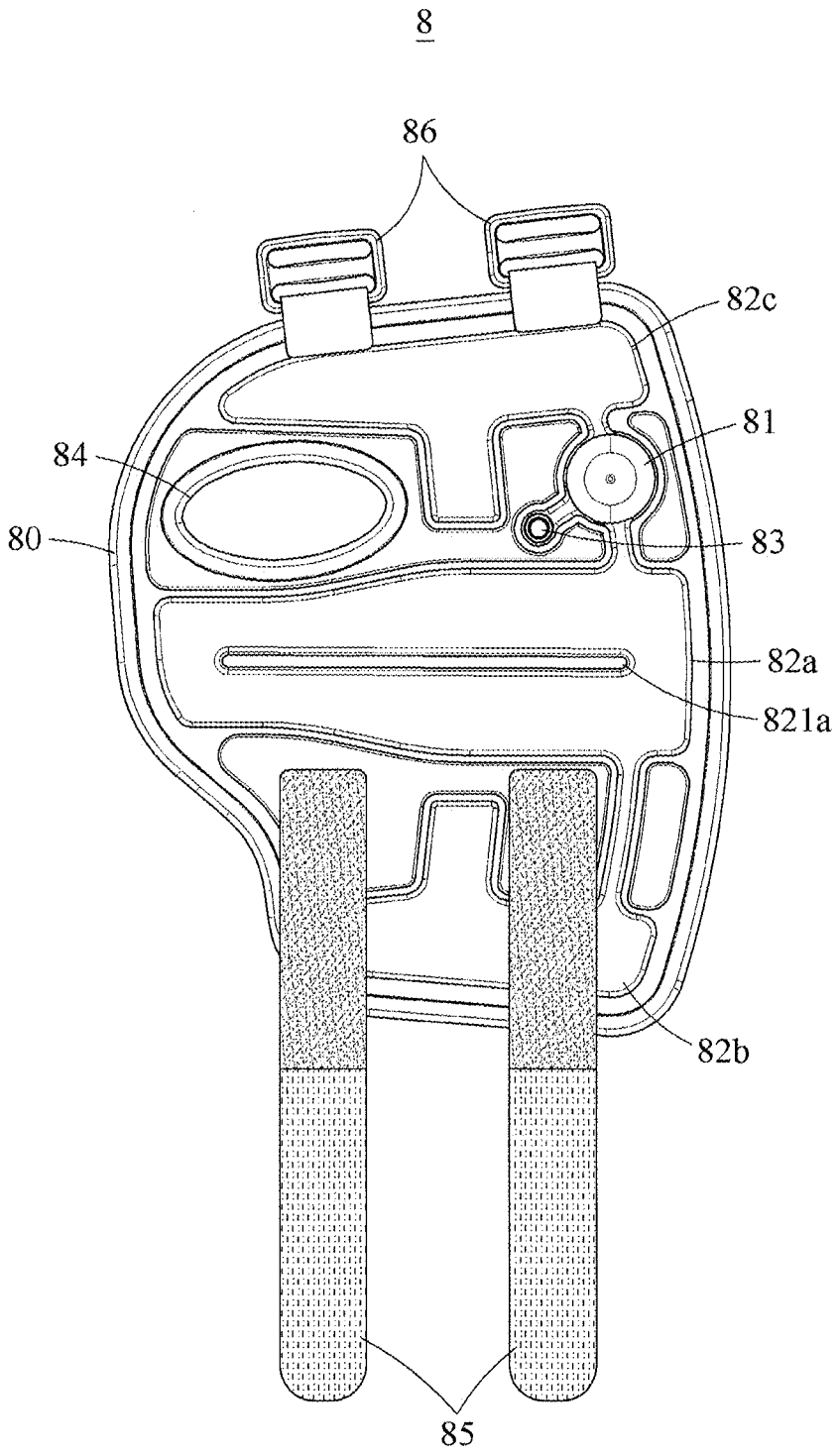
FIG. 13 is a plan view illustrating a wrist protector according to an example embodiment.
Figure 14A:
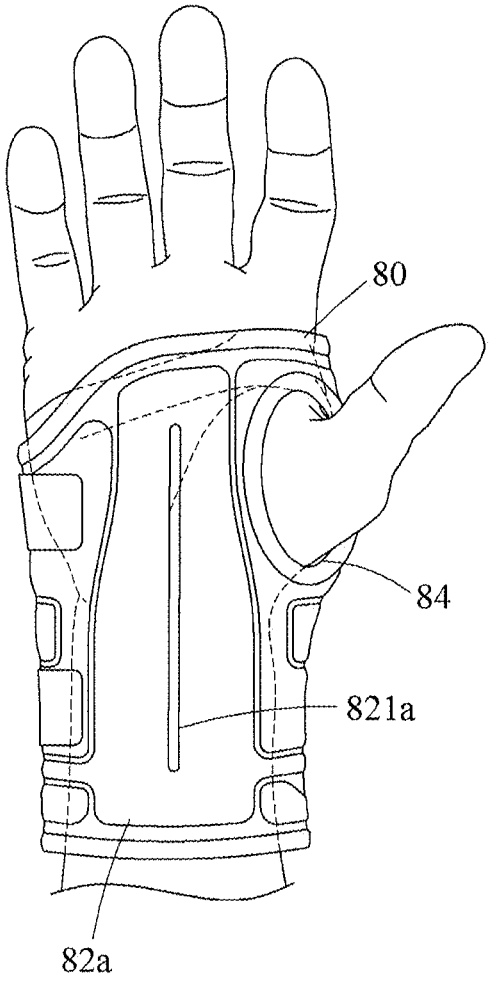
FIG. 14A is a perspective view illustrating a user wearing a wrist protector according to an example embodiment.
Figure 14B:
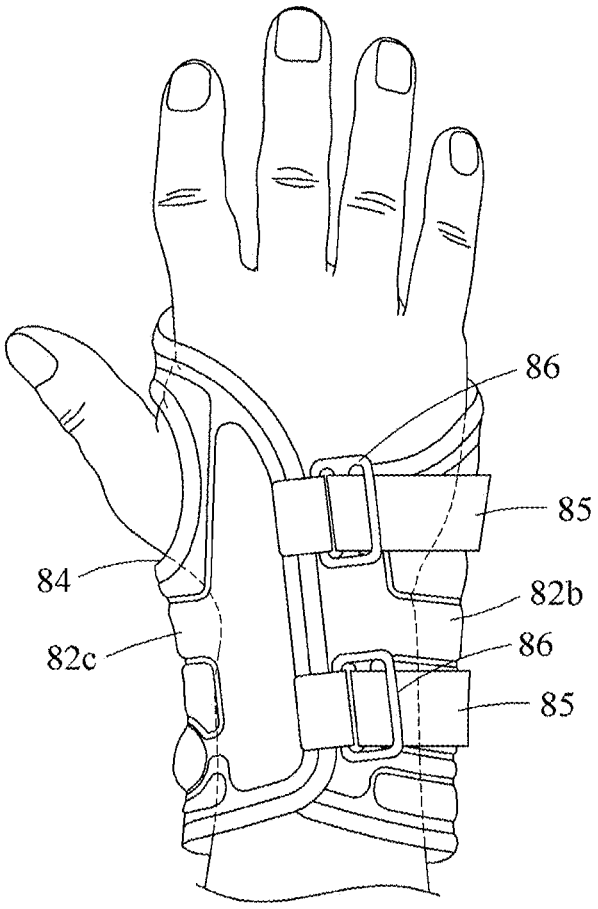
FIG. 14B is a perspective view illustrating a user wearing a wrist protector according to an example embodiment.
Figure 15:
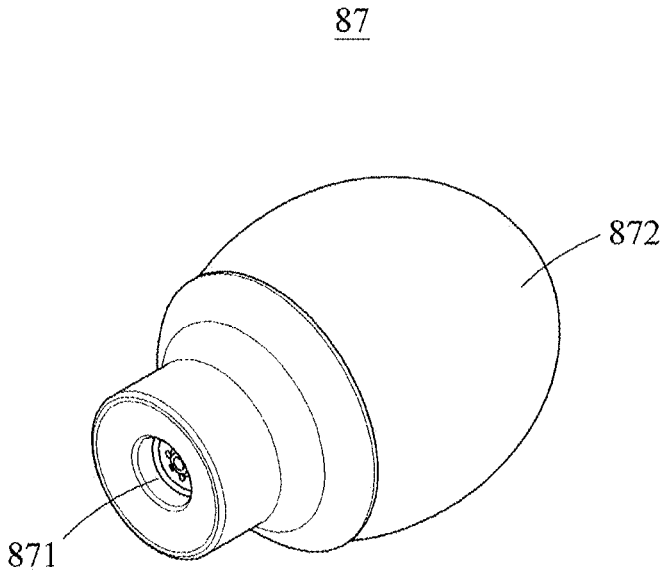
FIG. 15 is a perspective view illustrating a portable pump according to an example embodiment.
Figure 16A:
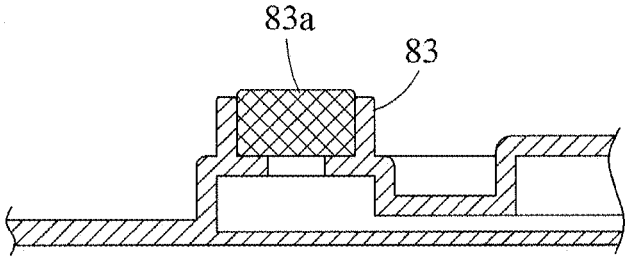
FIG. 16A is a cross-sectional view illustrating a discharge cover being mounted on a discharge valve according to an example embodiment.
Figure 16B:
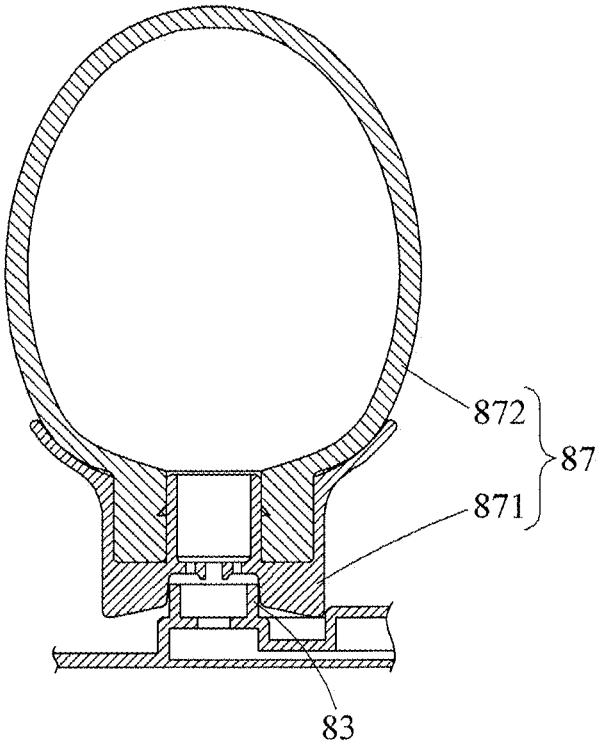
FIG. 16B is a cross-sectional view illustrating a portable pump being mounted on a discharge valve according to an example embodiment.

FIG. 13 is a plan view illustrating a wrist protector according to an example embodiment, FIG. 14A is a perspective view illustrating a user wearing the wrist protector according to an example embodiment, FIG. 14B is a perspective view illustrating the user wearing the wrist protector according to an example embodiment, FIG. 15 is a perspective view illustrating a portable pump according to an example embodiment, FIG. 16A is a cross-sectional view illustrating a discharge cover being mounted on a discharge valve according to an example embodiment, and FIG. 16B is a cross-sectional view illustrating the portable pump being mounted on the discharge valve according to an example embodiment.

Referring to FIGS. 13 through 16B, a wrist protector 8 may include a contact pad 80, a pump 81, a plurality of air tubes 82*a*, 82*b* and 82*c*, a discharge valve 83, a fixing hole 84, a wearable belt 85, a belt holder 86 and a portable pump 87.

The contact pad 80 may be worn on the wrist of the user. The plurality of air tubes 82*a*, 82*b* and 82*c* may be disposed in the contact pad 80, and the contact pad 80 may be wound around the wrist of the user to fix the wrist joint of the user. The user may wind the wrist with the contact pad 80 and adjust an amount of air injected into the plurality of air tubes 82*a*, 82*b* and 82*c*, thereby fixing the wrist. Further, the user may increase pressures of the plurality of air tubes 82*a*, 82*b* and 82*c* using the pump 81 or decrease the pressures of the plurality of air tubes 82*a*, 82*b* and 82*c* using the discharge valve 83 while wearing the wrist protector 8.

The pump 81 may inject air into the plurality of air tubes 82*a*, 82*b* and 82*c*. The pump 81 may be formed of an elastic material. The pump 81 may have a convex shape including a hollow in an initial state. In a case in which the user deforms the pump 81 with a finger and/or the palm, the pump 81 may return to the initial state by elasticity.

The plurality of air tubes 82*a*, 82*b* and 82*c* may be disposed in the contact pad 80. The plurality of air tubes 82*a*, 82*b* and 82*c* may include a main air tube 82*a* and a sub-air tube 82*b*, 82*c*.

The main air tube 82*a* may support a lower portion of the wrist of the user in a state in which the user is wearing the wrist protector 8. An upper portion of the main air tube 82*a* may have a relatively narrow width at convex portions like a scaphoid bone and a navicular bone, when compared to a central portion, such that the main air tube 82*a* may be easily bent. The upper portion of the main air tube 82*a* may be provided under the palm of the user, the central portion of the main air tube 82*a* may be provided under the wrist joint of the user, and a lower portion of the main air tube 82*a* may be provided under a forearm of the user.

The main air tube 82*a* may include an air-noninjectable region 821*a* formed in a longitudinal direction of the main air tube 82*a* at the central portion of the main air tube 82*a*. The air-noninjectable region 821*a* may enable external air to enter a space under the main air tube 82*a*, thereby reducing heat or sweat from the wrist of the user.

The sub-air tube 82*b*, 82*c* may communicate with the main air tube 82*a*. For example, the sub-air tube 82*b*, 82*c* may include a first sub-air tube 82*b* that supports a left side of the wrist, that is, an outer side of the wrist, and a second sub-air tube 82*c* that supports a right side of the wrist, that is, an inner side of the wrist, in a state in which the user is wearing the wrist protector 8 on a right hand (see FIGS. 14A and 14B).

An angle formed by the sub-air tube 82*b*, 82*c* and the main air tube 82*a* may be adjusted. The sub-air tube 82*b*, 82*c* may be connected to the main air tube 82*a* through an air passage having a relatively narrow width. When the contact pad 80 is wound around the wrist of the user, the angle formed by the sub-air tube 82*b*, 82*c* and the main air tube 82*a* may be adjusted based on a thickness of the wrist of the user. For example, in a case of a user having a relatively thick wrist, the angle formed by the sub-air tube 82*b*, 82*c* and the main air tube 82*a* may be relatively great. For example, in a case of a user having a relatively thin wrist, the angle formed by the sub-air tube 82*b*, 82*c* and the main air tube 82*a* may be relatively small.

The discharge valve 83 may discharge the air stored in the plurality of air tubes 82*a*, 82*b* and 82*c* to the outside. The discharge valve 83 may be opened or closed by the user, and the user may adjust the pressures of the plurality of air tubes 82*a*, 82*b* and 82*c* by opening or closing the discharge valve 83. The discharge valve 83 may be disposed adjacent to the pump 81. The user may manipulate the discharge valve 83 and the pump 81 disposed adjacent to each other, thereby easily adjusting the pressures of the plurality of air tubes 82*a*, 82*b* and 82*c*.

The fixing hole 84 may be provided in the contact pad 80 and enclose at least one of fingers of the user. For example, in a state in which the user is wearing the wrist protector 8, the fixing hole 84 may enclose the thumb of the user. The fixing hole 84 may prevent a separation of the wrist protector 8 from the user.

The pump 81, the discharge valve 83 and the fixing hole 84 may be disposed on the same side relative to the main air tube 82*a*. For example, all the pump 81, the discharge valve 83 and the fixing hole 84 may be disposed on the inner side of the wrist of the user. For example, the fixing hole 84 may enclose the thumb of the user, and the pump 81 and the discharge valve 83 may be disposed on the same side as the fixing hole 84 relative to the main air tube 82*a*. In this example, the discharge valve 83 and the fixing hole 84 may be disposed toward an inner side of the user, and thus the user may easily manipulate the discharge valve 83 and the fixing hole 84.

The wearable belt 85 and the belt holder 86 may fix the contact pad 80 to the wrist of the user. The wearable belt 85 may include a hook-and-loop structure. The wearable belt 85 may be connected to one side of the contact pad 80. The wearable belt 85 may pass through the belt holder 86. By adjusting a holding position of the wearable belt 85 on the belt holder 86, a circumference of the contact pad 80 may be adjusted to be suitable for the thickness of the wrist of the user.

The portable pump 87 may be mounted on the discharge valve 83 and inject air into the plurality of air tubes 82*a*, 82*b* and 82*c*. The user may individually carry the portable pump 87. The portable pump 87 may include a contact portion 871 and an elastic body 872. The contact portion 871 may fit with the discharge valve 83. The elastic body 872 may be connected to an upper side of the contact portion 871 and have a volume greater than a volume of the pump 81.

Referring to FIGS. 16A and 16B, the discharge valve 83 may include a discharge cover 83*a*. FIG. 16A illustrates the discharge valve 83 not communicating with the outside by the discharge cover 83*a*, and FIG. 16B illustrates the discharge valve 83 with the discharge cover 83*a* removed therefrom. To inject air into the plurality of air tubes 82*a*, 82*b* and 82*c* through the portable pump 87 or to discharge the air in the plurality of air tubes 82*a*, 82*b* and 82*c* to the outside through the discharge valve 83, the user may remove the discharge cover 83*a* from the discharge valve 83. The discharge cover 83*a* may have a shape and a size corresponding to an opening of the discharge valve 83. The discharge cover 83*a* may include a handle (not shown) for the user to easily remove or mount the discharge cover 83*a*.

The portable pump 87 has a greater volume than the pump 81, and thus may inject a larger amount of air into the plurality of air tubes 82*a*, 82*b* and 82*c* with one pumping. In a state in which air is yet to be injected into the plurality of air tubes 82*a*, 82*b* and 82*c*, the user may quickly inject air into the plurality of air tubes 82*a*, 82*b* and 82*c* using the portable pump 87. Then, the user may minutely adjust a pressure through the pump 81 and the discharge valve 83.

Referring to FIGS. 14A and 14B, the wrist protector 8 may support the circumference of the wrist of the user, thereby assisting the wrist joint of the user to not move. For example, the main air tube 82*a* that supports the lower portion of the wrist and the contact pad 80 that covers the wrist may prevent a flexion and an extension of the wrist of the user. Further, the sub-air tubes 82*b* and 82*c* that support both side portions of the wrist may prevent a radial deviation and an ulnar deviation of the wrist of the user. Further, the fixing hole 84 that fixes a finger of the user, for example, the thumb, and the contact pad 80 that encloses the perimeter of the wrist of the user may prevent a pronation and a supination of the user. As described above, the wrist protector 8 may prevent various motions of the wrist joint of the user.

Meanwhile, the wrist protector 8 may fix the lower portion and the side portions of the wrist with a large area through the main air tube 82*a* and the sub-air tube 82*b*, 82*c* such that the wrist of the user may not twist, while not restricting motions of the fingers of the user. For example, the thumb of the user may move freely while being inserted into the fixing hole 84, and the remaining fingers of the user may also move freely while being enclosed by the contact pad 80.

Figure 17:
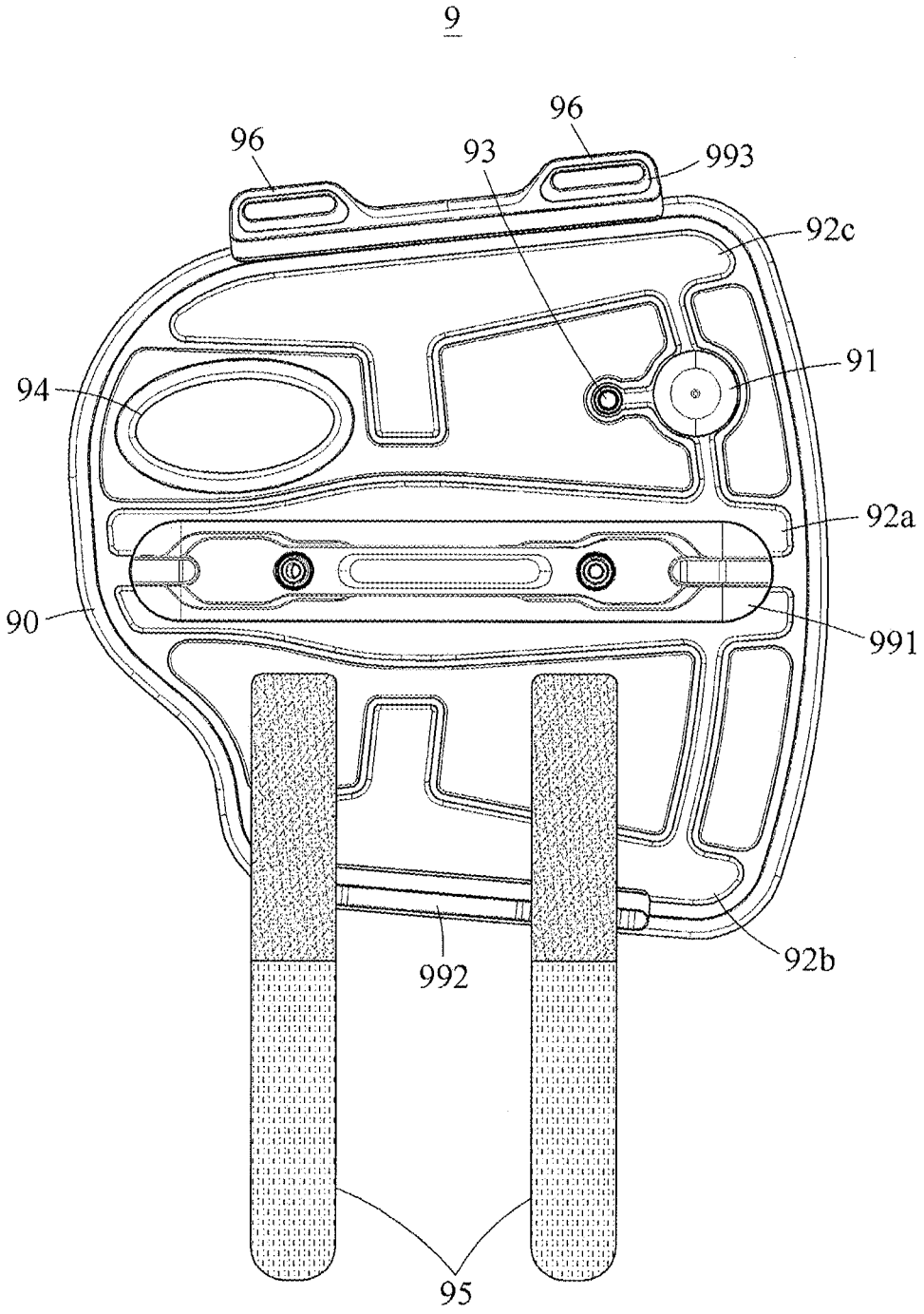
FIG. 17 is a plan view illustrating a wrist protector according to an example embodiment.
Figure 18:
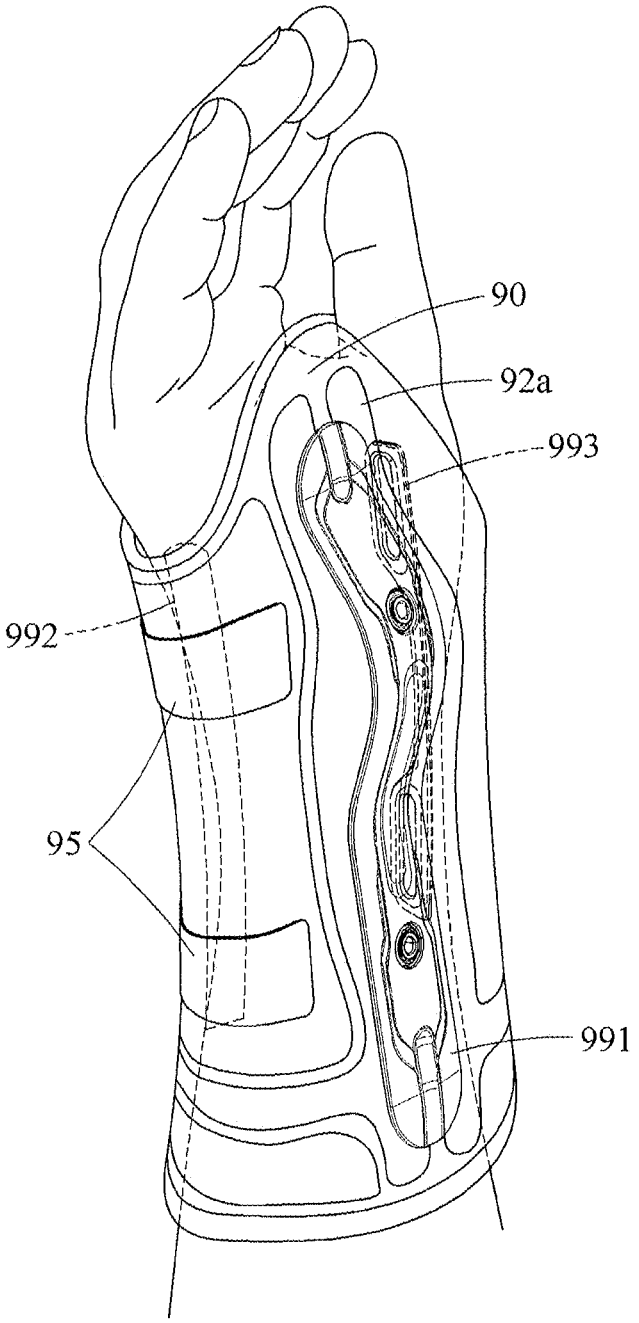
FIG. 18 is a perspective view illustrating a user wearing a wrist protector according to an example embodiment.

FIG. 17 is a plan view illustrating a wrist protector according to an example embodiment, and FIG. 18 is a perspective view illustrating a user wearing the wrist protector according to an example embodiment.

Referring to FIGS. 17 and 18, a wrist protector 9 may include a contact pad 90, a pump 91, a plurality of air tubes 92*a*, 92*b* and 92*c*, a discharge valve 93, a fixing hole 94, a wearable belt 95, a belt holder 96, a main plate 991, a loop plate 992 and a sub-plate 993. The plurality of air tubes 92*a*, 92*b* and 92*c* may include a main air tube 92*a* and a sub-air tube 92*b*, 92*c*.

The main plate 991 may support a lower portion of the main air tube 92*a*. The main plate 991 may support the main air tube 92*a* such that the elongating main air tube 92*a* may not be spaced apart from the wrist of the user by gravity or external force. The main plate 991 may be formed of a more rigid material than the main air tube 92*a*, for example, plastic. In a case of injecting air into the main air tube 92*a*, the main plate 991 may assist the main air tube 92*a* to maintain a state of contacting such that a uniform pressure may be applied to the wrist of the user although a relatively small amount of air is injected into the main air tube 92*a*. For example, the main plate 991 may have a shape corresponding to a curved shape of the lower portion of the wrist of the user. The main air tube 92*a* may maintain a state of contacting an inner wall of the main plate 991 and maintain a state of contacting the wrist of the user by being pressurized by the inner wall of the main plate 991.

The main plate 991 may support the lower portion of the wrist, the wrist joint, and the palm of the user. For example, a portion of the main plate 991 that supports a point connecting the lower portion of the wrist of the user and the wrist joint may have a convex shape. For example, the protection plate 22 may include three partitioned portions, in detail, a first portion, a second portion and a third portion (see FIG. 10).

The first portion may have a shape corresponding to the palm of the user. The first portion may be connected to the second portion while forming a predetermined angle with the second portion. The first portion may have a concave shape at a center thereof to stably support the palm of the user. The second portion may have a shape corresponding to the wrist portion of the user. For example, the second portion may have a slightly recessed shape at a center thereof so as to correspond to the wrist. The third portion may have a shape corresponding to the lower portion of the wrist of the user. For example, the third portion may have a convex shape to correspond to the wrist of the user which is cylindrical.

The loop plate 992 and the sub-plate 993 may be formed respectively at left and right edge portions of the contact pad 90. Similar to the main plate 991, the loop plate 992 and the sub-plate 993 may be formed of a more rigid material than the sub-air tube 92*b*, 92*c*.

The sub-air tube 92*b*, 92*c* may include a first sub-air tube 92*b* and a second sub-air tube 92*c*. The first sub-air tube 92*b* may be disposed between the main plate 991 and the loop plate 992, and the second sub-air tube 92*c* may be disposed between the main plate 991 and the sub-plate 993.

The loop plate 992 and the sub-plate 993 may respectively assist the first sub-air tube 92*b* and the second sub-air tube 92*c* to maintain a state of contacting the wrist joint of the user. For example, both side portions of the first sub-air tube 92*b* may be fixed by the main plate 991 and the loop plate 992, respectively. Thus, although air of an amount sufficient to fix a joint of the user is injected into the first sub-air tube 92*b*, the first sub-air tube 92*b* may not be spaced apart from a body of the user. Similarly, both side portions of the second sub-air tube 92*c* may be fixed by the main plate 991 and the sub-plate 993, respectively. Thus, although air of an amount sufficient to fix the joint of the user is injected into the second sub-air tube 92*c*, the second sub-air tube 92*c* may not be spaced apart from the body of the user.

A plurality of belt holders 96 may be formed to be spaced apart from each other on the sub-plate 993 which is relatively rigid when compared to the air tubes 92*a*, 92*b* and 92*c*. By the above structure, a plurality of wearable belts 95 may enable the wrist protector 9 to support the wrist of the user at an appropriate position while maintaining an interval therebetween.

According to an example embodiment, a user may wind a wrist with a contact pad and then increase an amount of air injected into an air pad attached to an outer circumferential surface of the contact pad, thereby conveniently wearing a wrist protector with one hand.

Further, the user may increase a pressure of an air tube using a pump or decrease the pressure of the air tube using a discharge valve, thereby frequently adjusting the pressure while wearing the wrist protector.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A wrist protector, comprising:

a contact pad to be worn on a wrist of a user;

a plurality of air tubes disposed on the contact pad, the plurality of air tubes comprising a main air tube and a sub-air tube;

a pump configured to inject air from an outside into the plurality of air tubes;

a discharge valve configured to discharge the air stored in the plurality of air tubes to the outside;

a main plate configured to support a lower portion of the main air tube; and a loop plate and a sub-plate respectively formed at left and right edge portions of the contact pad, wherein the sub-air tube comprises:

a first sub-air tube disposed between the main plate and the loop plate; and a second sub-air tube disposed between the main plate and the sub-plate.

2. The wrist protector of claim 1, further comprising:

a fixing hole provided in the contact pad and configured to enclose at least one finger of the user.

3. The wrist protector of claim 2, wherein the main air tube configured to support a lower portion of the wrist of the user, and the sub-air tube configured to communicate with the main air tube, wherein an angle formed by the main air tube and the sub-air tube is adjustable.

4. The wrist protector of claim 3, wherein the pump, the discharge valve and the fixing hole are disposed on the same side relative to the main air tube.

5. The wrist protector of claim 3, wherein the main air tube includes an air-noninjectable region formed at a central portion of the main air tube in a longitudinal direction of the main air tube.

6. The wrist protector of claim 1, further comprising:

a check valve configured to allow an airflow from the pump to the plurality of air tubes and block an airflow from the air tubes to the pump.

7. A wrist protector comprising, a contact pad to be worn on a wrist of a user;

a plurality of air tubes disposed on the contact pad;

a pump configured to inject air from an outside into the plurality of air tubes;

a discharge valve configured to discharge the air stored in the plurality of air tubes to the outside; and a portable pump to be mounted on the discharge valve, the portable pump configured to inject air into the plurality of air tubes, wherein the portable pump comprises:

a contact portion configured to fit with the discharge valve; and an elastic body connected to an upper side of the contact portion, the elastic body having a volume greater than a volume of the pump.

8. A wrist protector, comprising:

an air tube configured to support a wrist joint of a user;

a pump including an air inlet communicating with an outside and an air transfer hole communicating with the air tube;

a check valve configured to allow an airflow from the pump to the air tube and block an airflow from the air tube to the pump;

a discharge valve configured to discharge air in the air tube to the outside; and a protection plate formed of a more rigid material than the air tube and configured to enclose an outer circumferential surface of the air tube, wherein the air tube comprises:

a first tube portion and a second tube portion partitioned on both sides by a thermobonded line formed at a center of the air tube; and a connecting tube portion configured to enable the first tube portion and the second tube portion to communicate with each other, wherein the air tube includes an air-noninjectable region positioned between the first tube portion and the second tube portion and enclosed by thermobonded line, wherein the protection plate comprises:

a first branch plate and a second branch plate configured to branch in both directions from a central line of the protection plate; and a vent positioned between the first branch plate and the second branch plate, the vent overlapping the air-noninjectable region.

9. The wrist protector of claim 8, wherein the discharge valve comprises:

a discharge hose configured to allow an airflow between the air tube and the outside; and a discharge bolt configured to open and close the discharge hose.

10. The wrist protector of claim 9, wherein the discharge bolt comprises a bolt flow path configured to allow the airflow between the air tube and the outside, and one end of the bolt flow path is blocked by an inner wall of the discharge hose in a closed state and opened toward the outside in an opened state.

11. The wrist protector of claim 10, wherein the discharge bolt is spirally connected to the inner wall of the discharge hose, and a discharge end of the bolt flow path is exposed to the outside when the discharge bolt is turned more than a predetermined angle with respect to the discharge hose.

* * * * *